US009854371B2

(12) United States Patent
Lester, III

(10) Patent No.: US 9,854,371 B2
(45) Date of Patent: Dec. 26, 2017

(54) INFORMATION PROCESSING SYSTEM, APPARATUS AND METHOD FOR MEASURING A HEAD-RELATED TRANSFER FUNCTION

(71) Applicant: Small Signals, LLC, Rumson, NJ (US)

(72) Inventor: James Patrick Lester, III, Rumson, NJ (US)

(73) Assignee: Small Signals, LLC, Rumson, NJ (US)

( * ) Notice: Subject to any disclaimer, the term of this patent is extended or adjusted under 35 U.S.C. 154(b) by 35 days.

(21) Appl. No.: 14/920,236

(22) Filed: Oct. 22, 2015

(65) Prior Publication Data

US 2016/0119731 A1 Apr. 28, 2016

Related U.S. Application Data

(60) Provisional application No. 62/067,105, filed on Oct. 22, 2014.

(51) Int. Cl.

| | |
|---|---|
| ***H04R 29/00*** | (2006.01) |
| ***H04S 7/00*** | (2006.01) |
| *H04R 3/00* | (2006.01) |

(52) U.S. Cl.

CPC ..... *H04R 29/001* (2013.01); *H04S 7/40* (2013.01); *H04R 3/005* (2013.01); *H04S 2420/01* (2013.01)

(58) Field of Classification Search

CPC ..... H04S 2420/01; H04S 7/40; H04R 29/001; H04R 3/005

See application file for complete search history.

(56) References Cited

U.S. PATENT DOCUMENTS

| | | | |
|---|---|---|---|
| 2005/0280519 | A1 | 12/2005 | Nagata |
| 2013/0322667 | A1 | 12/2013 | Christensen |
| 2014/0114560 | A1 | 4/2014 | Jensen et al. |
| 2014/0198933 | A1 | 7/2014 | Totsuka et al. |

OTHER PUBLICATIONS

International Search Report and Written Opinion for Application No. PCT/US2015/056896 dated Jan. 11, 2016.

*Primary Examiner* — Regina N. Holder

(74) *Attorney, Agent, or Firm* — Lerner, David, Littenberg, Krumholz & Mentlik, LLP

(57) ABSTRACT

Method and apparatus for measuring a Head-Related Transfer Function (HRTF) may include determining position and orientation of an object relative to an audio signal generating device having a first known position and orientation, based on tracking information indicating position and orientation of the object. Movement data indicating direction of movement to position the object at a target position and orientation in relation to a predetermined position and orientation of the audio signal generating device may be generated, according to the relative position and orientation of the object. When the object is determined to be at the target position and orientation, the HRTF may be determined based on detection at the object of an audio signal from the audio signal generating device at the first known position and orientation while the object is at the target position and orientation.

20 Claims, 8 Drawing Sheets

INFORMATION PROCESSING SYSTEM, APPARATUS AND METHOD FOR MEASURING A HEAD-RELATED TRANSFER FUNCTION

CROSS-REFERENCE TO RELATED APPLICATIONS

The present application claims the benefit of the filing date of U.S. Provisional Patent Application No. 62/067,105 filed Oct. 22, 2014, the disclosure of which is hereby incorporated herein by reference.

FIELD OF DISCLOSURE

The present disclosure relates to an information processing system, apparatus, method and program for processing sound information. More particularly, the present disclosure relates to spatial hearing and psychoacoustics, and measuring a Head-Related Transfer Function using an information processing system, apparatus, method and program.

BACKGROUND

Referring to FIG. 1, in a sound space, a head-related transfer function (HRTF) represents change from an original sound from a sound source S to listening sound at a listener U. The position of the sound source S is represented by a radius vector r and angles A and B in polar coordinates of which the position of the listener is the origin O. The radius vector r is a distance from a middle point of the listener's head to the position of the sound source S; the angle A is an azimuth angle formed by a front or rear direction of the listener and a direction of the sound source S in a horizontal plane. The angle B is an elevation angle formed by a horizontal plane including the position of the listener and the direction of the sound source S in a vertical plane.

Conventional methods of measuring a HRTF typically involve generating a sound field at a given position by a test signal from the sound source S, which may include one or more transducers, and subsequently measuring a resultant sound field at a position of the listener by one or more other transducers, such as microphones (not shown in FIG. 1). In such methods, a test subject, either live or simulated, is located at one position, and microphones are placed in or near the ear canals of the test subject. The test subject is generally in a stationary position throughout the measurement process and movement of the test subject is discouraged.

Usually, the sound source is located at a position remote from the position of the test subject, for example, at a distance r and angles A and B in relation to the position of the test subject, and a test signal is produced by the sound source and measured by the transducers located at or near the ear canals of the test subject. The sound source is then typically moved to another position, for example, at a same distance r and angle A and a different angle B relative to the position of the test subject, and the process is repeated until HRTFs have been measured for each desired relative position of the sound source.

The accurate movement and positioning of the sound source is often time consuming. Therefore, multiple sound sources are often utilized and located at multiple positions, such that the time required for setup and measurement is minimized. In this case, the equipment needed to position the multiple sound sources has a typical drawback of being large and unwieldy and unsuitable for general commercial use.

There exists a need for an improved system, apparatus and method for measuring a HRTF quickly, accurately and with ease.

SUMMARY

According to the aspects of the present disclosure, head-related transfer functions may be measured by modifying position and orientation of a test subject relative to a sound source that is maintained fixed in position and orientation, according to at least one of audible or visual stimuli presented to the test subject.

In accordance with one aspect of the present disclosure, a method for measuring a Head-Related Transfer Function (HRTF) may include controlling, by a processing device: determining position and orientation of an object relative to an audio signal generating device having a first known position and orientation, based on tracking information indicating position and orientation of the object; generating movement data indicating direction of movement to position the object at a target position and orientation in relation to a predetermined position and orientation of the audio signal generating device, according to the relative position and orientation of the object; and when the object is determined to be at the target position and orientation, determining the HRTF based on detection at the object of an audio signal from the audio signal generating device at the first known position and orientation while the object is at the target position and orientation.

In accordance with one aspect of the present disclosure, an apparatus for measuring a Head-Related Transfer Function (HRTF) may include circuitry configured to control: determining position and orientation of an object relative to an audio signal generating device having a first known position and orientation, based on tracking information indicating position and orientation of the object; generating movement data indicating direction of movement to position the object at a target position and orientation in relation to a predetermined position and orientation of the audio signal generating device, according to the relative position and orientation of the object; and when the object is determined to be at the target position and orientation, determining the HRTF based on detection at the object of an audio signal from the audio signal generating device at the first known position and orientation while the object is at the target position and orientation.

In accordance with an aspect of the present disclosure, a non-transitory storage medium may have recorded thereon a program executable by a computer. The program may include determining position and orientation of an object relative to an audio signal generating device having a first known position and orientation, based on tracking information indicating position and orientation of the object; generating movement data indicating direction of movement to position the object at a target position and orientation in relation to a predetermined position and orientation of the audio signal generating device, according to the relative position and orientation of the object; and when the object is determined to be at the target position and orientation, determining the HRTF based on detection at the object of an audio signal from the audio signal generating device at the first known position and orientation while the object is at the target position and orientation.

DETAILED DESCRIPTION

The technology of the present disclosure may measure Head-Related Transfer Functions (HRTFs) by utilizing position tracking information and at least one of audible or visual guidance information to position and orient a head region of a test subject, which may include the head and torso of the test subject, at a plurality of target positions and orientations with respect to a position and orientation of a sound generating source, where the HRTFs are measured with the head region of the test subject at the respective target positions and orientations while the sound generating source is maintained fixed in position and orientation during the HRTF measurement. Advantageously, the technology may avoid the time consuming method of maintaining a stationary position and orientation of the head region of the test subject, and precisely changing the positions and orientations of the sound generating source (s) with respect to the test subject.

Figure 1:
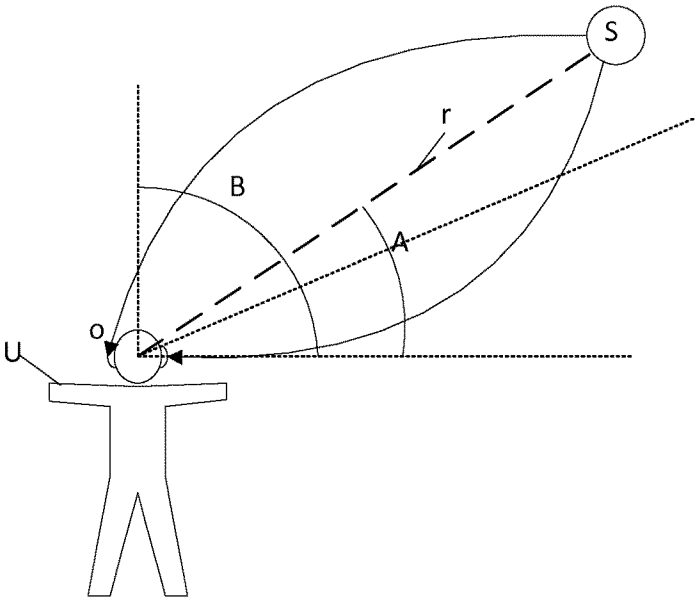
FIG. 1 is a diagram illustrating a sound source in a space relative to a user.
Figure 2:
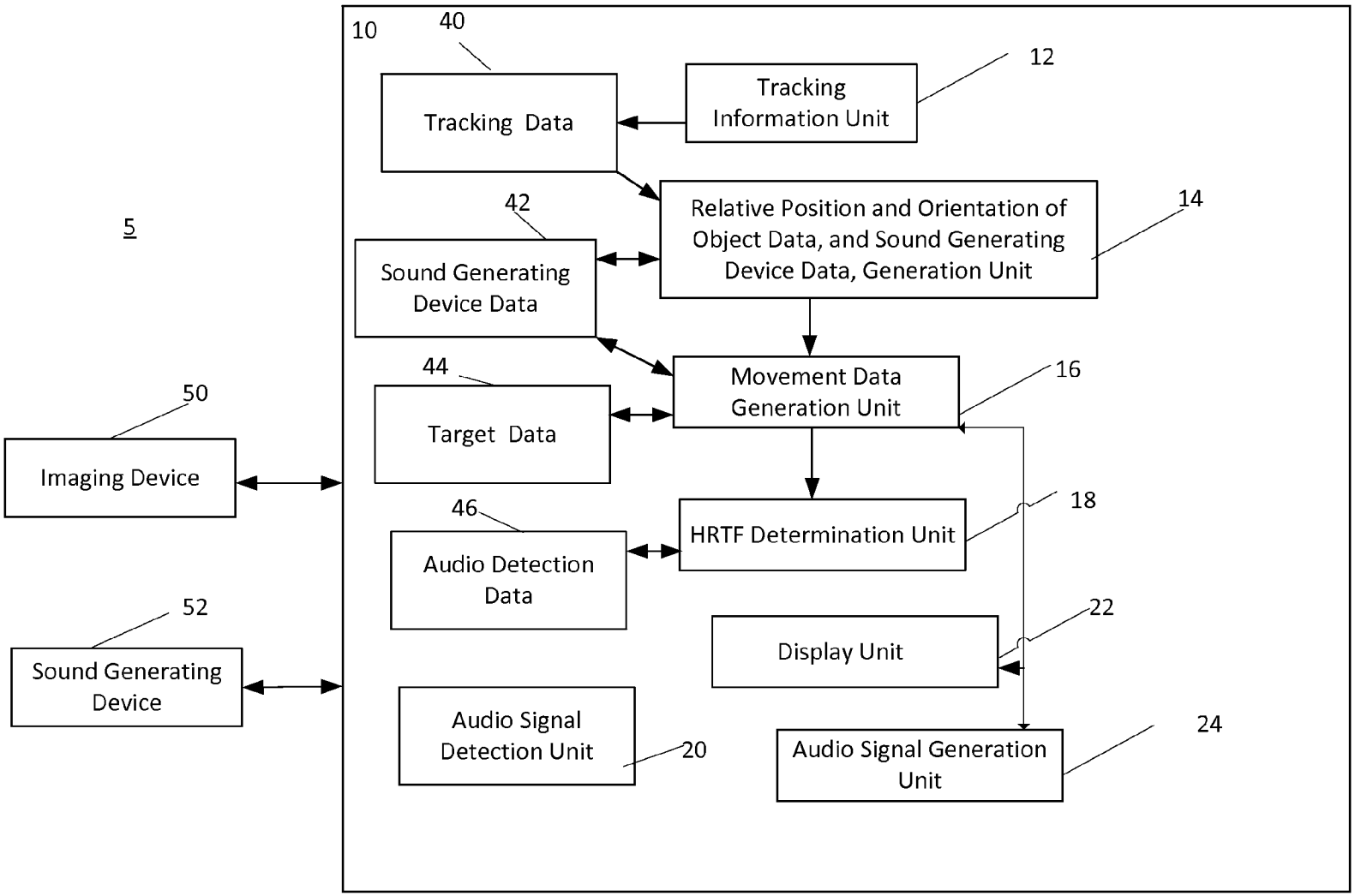
FIG. 2 is a block diagram of a system for measuring a HRTF, according to the present disclosure.
Figure 3:
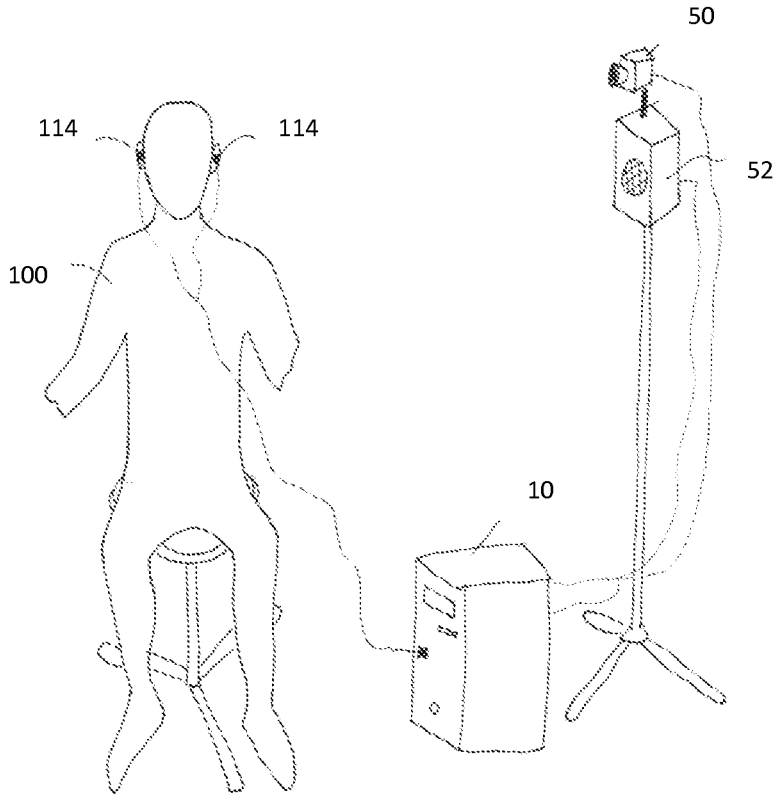
FIG. 3 is a perspective view of an environment including a system for measuring a HRTF, according to the present disclosure.
Figure 4:
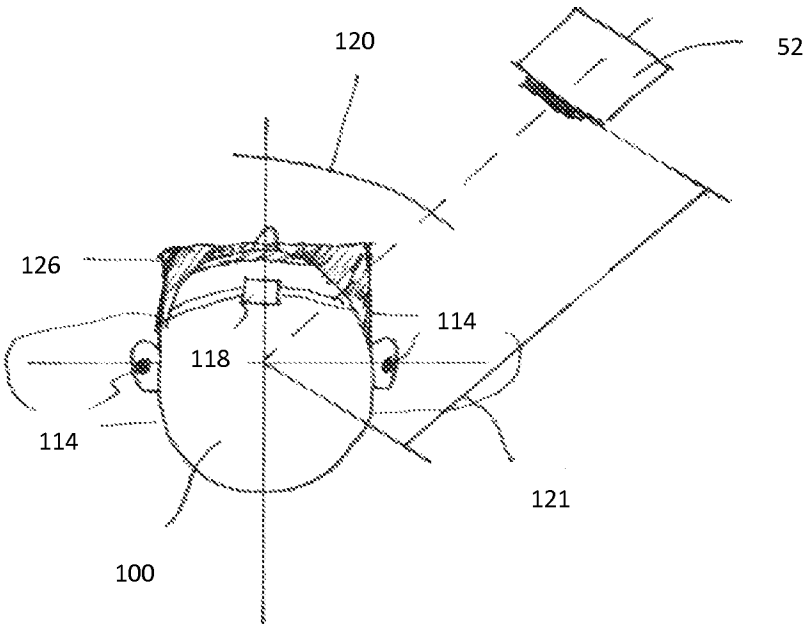
FIG. 4 is a top view of elements of the system of FIG. 2 in the environment of FIG. 3.
Figure 5:
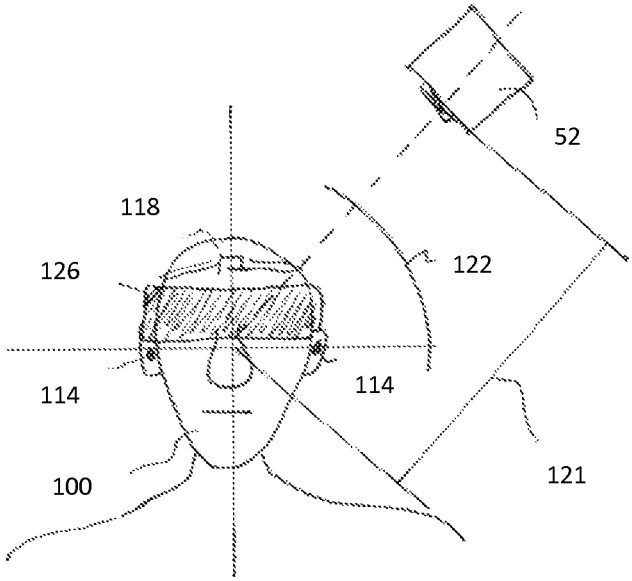
FIG. 5 is a front view of elements of the system of FIG. 2 in the environment of FIG. 3.

FIG. 2 is a block diagram illustrating a functional configuration of an exemplary information processing system 5 for measuring HRTFs, in accordance with an embodiment of the present disclosure. An exemplary implementation of the system 5 is illustrated in FIGS. 3-5.

Referring to FIG. 2, the system 5 may include an information processing apparatus 10, an imaging device 50 and a sound generating device 52. The apparatus 10 may include a tracking information unit 12, a relative position and orientation of object data and sound generating device data generation unit 14, a movement data generation unit 16, an HRTF determination unit 18, an audio signal detection unit 20, a display unit 22 and an audio signal generation unit 24. In addition, the apparatus 10 may refer to tracking data 40, sound generating device data 42, target data 44 and audio detection data 46 stored in a storage device or the like. The apparatus 10 may be configured to be attached to the head of the user 100, such as a head mounted device.

The tracking information unit 12 may generate tracking data 40, which indicates a current position and orientation of a head region of a user 100, where the head region includes the user's head and torso, and also a current position and orientation of the sound generating device 52. The tracking data 40, for example, may be based on position and orientation data generated at the apparatus 10 using one or more of electromagnetic, acoustic or optical techniques for determining current position and orientation of each of a head mounted display and the device 52. The unit 12, for example, may operate in conjunction with an external device (s) (not shown), and include a position tracking device to transmit and receive signals, such as electromagnetic, optical or acoustic signals, and determine current position and orientation of the head mounted device, and thus, the object (head region of a person) to which the head mounted device is coupled, based on the received signals and known positioning and orientation data of the external device(s). In one embodiment, the tracking information unit 12 may receive imaging data of the user 100 obtained from the imaging device 50, such as a camera 50, that includes communication capabilities. The imaging device 50 may be controlled by the tracking information unit 12 to image the user and supply imaging data corresponding to images including the user to the apparatus 10.

The generation unit 14 may continuously determine a position and orientation of the head region of the user 100 relative to a position and orientation of the sound generating device 52, based on the tracking data 40. From such determination of the relative position and orientation of the head region at an initial position and orientation of the head region of the user, the unit 14 may determine information indicating a reference known relative position and orientation of the sound generating device 52. The information indicating the reference known relative position and orientation of the sound generating device 52 may include information indicating the device 52 being at a specific distance 121 from, and specific azimuth angle 120 and specific elevation angle 122 in relation to, the initial position and orientation of the user's head region, and may be stored, with information indicating the positions and orientations respectively of the head region and the device 52 from which the reference known relative position and orientation are determined, as the sound generating device data 42.

The movement data generation unit 16 may determine target positions and orientations of the user's head region at which HRTFs may be measured, by performing an automatic calibration process. In one embodiment of the calibration process, where the device 52 is at a different position and orientation than the position and orientation of the device 52 at which the initial position and orientation of the head region of the user 100 relative to the position and orientation of the sound generating device 52 is determined, the unit 16 may use the information in the sound generating device data 42, to determine different target positions and orientations of the user's head region in relation to second known positions and orientations of the generating device 52 at which HRTFs may be measured. In another embodiment of the calibration process where the device 52 is maintained fixed at a same position and orientation as the position and orientation of the device 52 at which the initial position and orientation of the head region of the user 100 relative to the position and orientation of the sound generating device 52 is determined, the unit 16 may use the information in the sound generating device data 42, by itself, to determine different target positions and orientations of the user's head region at which to measure HRTFs.

In addition, the movement data generation unit 16 may determine movement data to guide the user to move his head region in a specific direction(s), so the user's head region is positioned at respective precise target positions and orientations, in relation to a position and orientation of the sound generating device 52 which is maintained at a fixed position and orientation for the HRTF measurement. The movement data may be generated according to a current known relative position and orientation of the head region in relation to the device 52 determined by the unit 14 and the target data 44. The target data 44 may be determined by the unit 16 using the known position and orientation of the sound generating device indicated in the data 42, and indicate one or a plurality of respective target positions and orientations for the user's head region relative to a fixed position and orientation of the sound generating device 52 at which a HRTF is to be determined, according to the present disclosure.

The HRTF determination unit 18 may determine, when the user's head region is determined to be at a target position and orientation, an HRTF from audio detection data 46 generated by the audio signal detection unit 20. Referring to FIGS. 3-5, the detection unit 20 may include transducers 114, such as microphones, for insertion into ear canals of the user 100. The microphones may detect audio signals from the sound generating device 52 and the detected audio signals may be stored by the unit 20 as audio detection data 46. The head region of the user and the device 52 do not move while the HRTF is determined.

The sound generating device 52 may be an audible sound source external to the apparatus 10 and include communication capabilities and a speaker that reproduces sound data toward the user. As discussed herein, the device 52 may communicate with the apparatus 10, and be located at known position and azimuth and elevation angles relative to a known position and orientation of the head region of the user 100. The sound source may, for example, be a small, full-range audio loudspeaker capable of reproducing frequencies between 100 Hz and 16 kHz.

The audio signal detection unit 20 may be an audible sound detector that generates sound data based on detection of sound. The unit 20 may include measuring transducers 114 that take the form of small omnidirectional microphones, selected to provide a "flat" frequency response with minimal deviation (<5 dB) across all frequencies in the audible range.

The audio signal generation unit 24 may be a sound source that reproduces sound data through headphones or earbuds that may be a part of the unit 24. The apparatus 10 may be configured such that headphones or earbuds of the unit 24 may be attached or coupled to the head of the user 100 and positioned covering or inserted in ear canals of the user's ears, respectively.

The display unit 22 may be a display data generating device that displays images based on the movement data on a display screen that is part of the unit 22. The apparatus 10 may be configured such that the display screen of the unit 22 may be attached to the head of the user 100 and cover the user's eyes, such as in a head mounted display device configuration. In one embodiment, the display screen may be configured as part of a corneal implant or smart contact lens.

Figure 6:
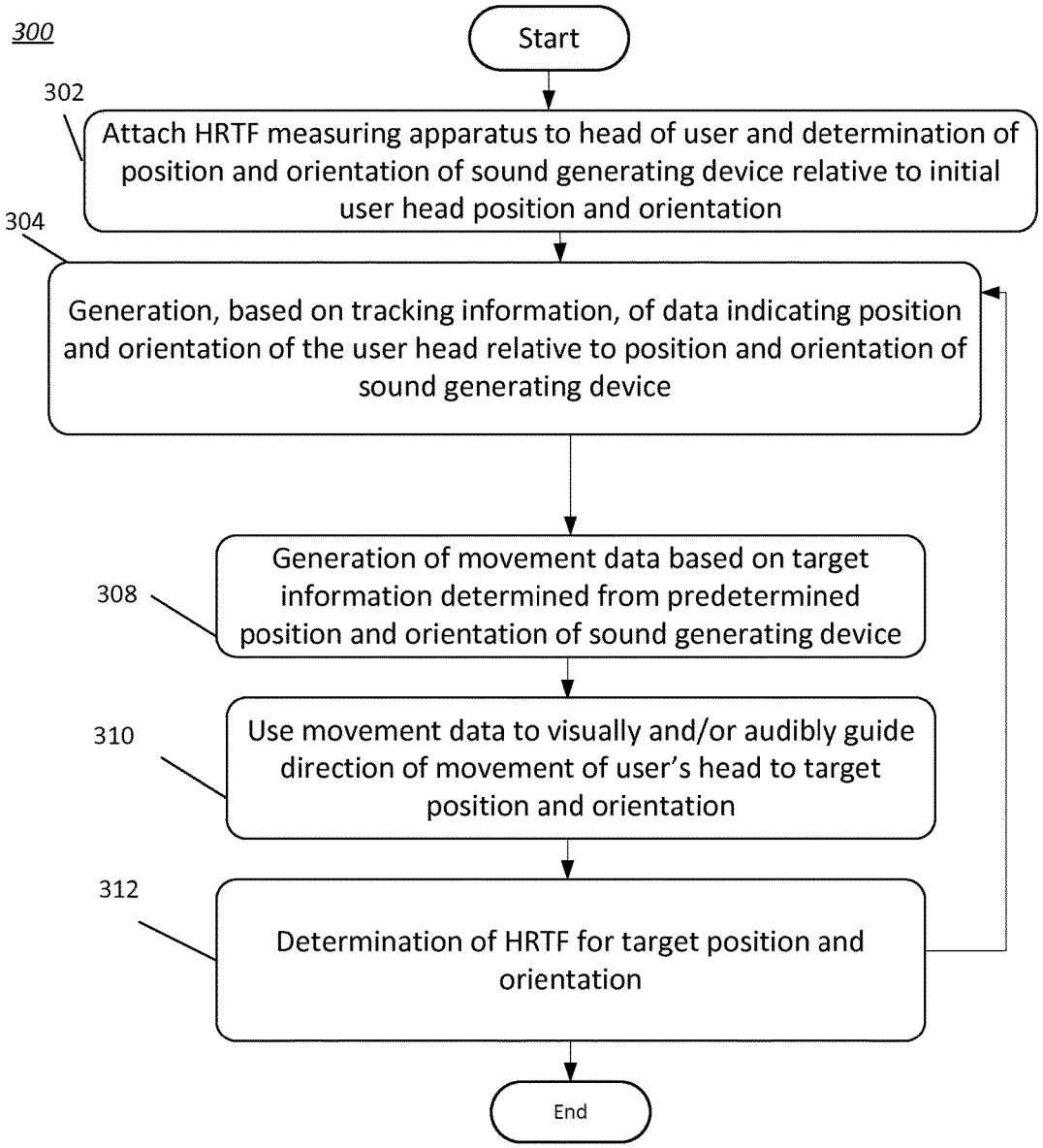
FIG. 6 is a flow chart illustrating steps of a process to measure a HRTF, according to the present disclosure.
Figure 7:
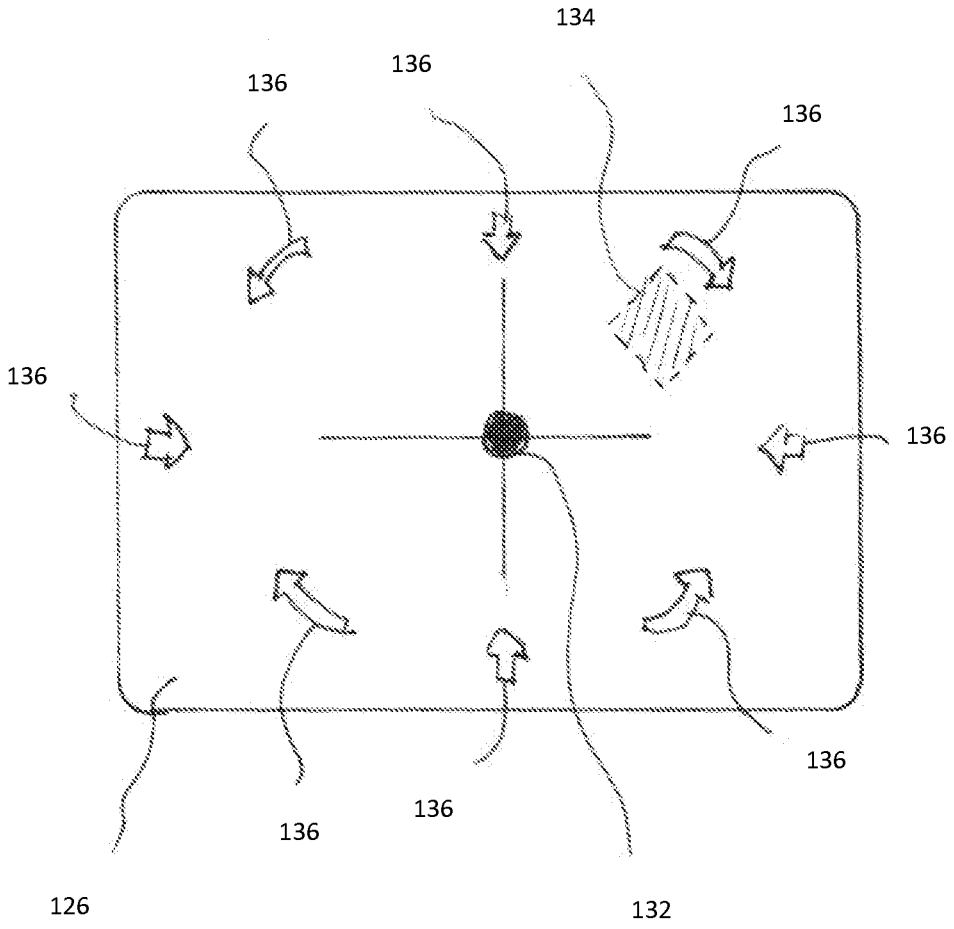
FIG. 7 is an illustration of an exemplary display, according to the present disclosure.

FIG. 6 is a flowchart that illustrates an embodiment of a method 300 of operations according to the present disclosure. The method illustrated in the flow chart of FIG. 6 may be executed by one or more processors. In some examples, the method illustrated in the flow chart may be carried out periodically, continuously, as needed, or in another manner. The method may include one or more operations, functions, or actions as illustrated by one or more of the blocks. A block may represent a process of information, a transmission of information, or a combination thereof.

In a flowchart, although the blocks are illustrated in a sequential order, these blocks may also function in parallel or in a different order than those described herein, depending on the functionalities involved. Also, the various blocks may be combined into fewer blocks, divided into additional blocks, sub-blocks, or omitted based upon the desired implementation. Furthermore, blocks illustrated in the flow chart may be combined with one another, in part or in whole, based on the functionalities involved. The method 300 is described below in connection with an exemplary implementation and operation of the system 5 as shown in FIGS. 3-5 and 7.

Referring to FIG. 6, at block 302, transducers 114 of the audio detection unit 20 may be inserted into the ear canals of the user 100, and a position tracking device 118 of the unit 12 may be attached to the head of the user 100. Further, a visual display 126 of the display unit 22 may be attached to the head of user 100. In addition, a sound generating transducer as the sound generating device 52 may be positioned remotely from the user 100.

In one embodiment, the measuring transducers or microphones 114 and the tracking device 118 may be integral to the apparatus 10, for example, a part of the units 20 and 12, respectively, and the apparatus may be configured to be attached to the head of the user as a head mounted component. In an alternative embodiment, the transducers 114 and the tracking device 118 are separate from and external to the apparatus 10 and include communication capabilities for communicating data with the apparatus 10, via wire or wireless communication.

In block 302, the generation unit 14 may use tracking information generated by the tracking unit 12 to determine position and orientation of the sound generating device 52, which has a known position and orientation, relative to a known initial position and orientation of the head region of the user 100. Such determination may be performed while the user keeps his head region still and the device 52 is maintained still. The tracking information may be based on imaging data from a camera 50, which is positioned remotely from the user 100 and desirably is coupled to the sound generating device 52, such that the camera 50 and device 52 are at the same position and orientation. The unit 14 may use information of the position and orientation of the sound generating device relative to the initial position and orientation of the user's head region, which is indicated by the tracking information, to generate and store as the sound generating device position data 42 information indicating a known position and orientation of the sound generating device and a reference known relative position and orientation of the head region in relation to the device 52. Such known position and orientation of the sound generating device indicates a predetermined position and orientation of the sound generating device, which may be used to determine respective target locations and orientations of the user's head region at which HRTFs are to be determined for the user. The reference known relative position and orientation of the sound generating device indicates, with regard to the known initial position and orientation of the user's head region that the sound generating device 52 is located a specific distance 121 from the head region of the user 100 with a specific elevation angle 122 and a specific azimuth angle 120.

In another embodiment, a reference known position and orientation of the sound generating device may be provided by external data supplied to the apparatus 10, and information of such reference known position and orientation may be stored in memory. Similarly as described above, the provided reference known position and orientation may be used to position and orient the sound generating device a specific target distance 121 from the head region of the user 100 with a specific target elevation angle 122 and a specific azimuth angle 120, such as when the head region of the user 100 is at an initial known position and orientation in relation to the sound generating device.

In one embodiment, the tracking information unit 12 may be integral with the apparatus 10 contained within a visual display 126 which is part of the display unit 22, where the apparatus 10 is configured as a head mounted device.

The tracking information may be determined, for example, based on electromagnetic, acoustic or optical signals transmitted from and received by the tracking device 118 of the unit 12. The tracking device 118, which is suitably configured to transmit and receive electromagnetic, acoustic or optical signals, may perform processing to determine current position and orientation of the head region from the received signals and related data using conventional techniques. The tracking information unit 12 may be capable of measuring current position and orientation of the head region of the user 100 with six degrees of freedom. In an alternative embodiment, the tracking unit 12 may control the camera 50 to capture images of the user 100 including the user's head region, and to transmit image data representative of the images to the apparatus 10, and then process the image data as received by the tracking device, optionally with other tracking position information, to determine tracking information indicating the current position and orientation of the head region of the user 100 with six degrees of freedom. In one embodiment, the camera may generate other image data indicating current position and orientation of the user's head region, such as from imaging by the camera of infrared LEDs arranged on a head mounted display worn on the user's head. The processing of received optical, electromagnetic or acoustic signals and/or the image data at the unit 12, to obtain the tracking information indicating the current position and orientation of the head region of the user 100, and also indicating the current position and orientation of the device 52, may be performed using conventional techniques well known in the art.

In one embodiment, the audio signal detection unit 20 may measure digital signals at a sampling rate of more than 32 kHz, and the sound generating device 52 may produce sound from audio signals having a bit depth of more than 12 bits. It is to be understood that sampling rates lower than 32 kHz and bit depths less than 12 bits may be used, according to aspects of the present invention.

In block 304, the user 100 may move his head region from the initial position and orientation to obtain a target position and orientation, where the target position and orientation is determined from the information indicating the reference known relative position of the head region and the known position and orientation of the sound generating device in the data 42, as further discussed below. Further in block 304, with the head region of the user at other than the initial head region position and orientation, the tracking information unit 12 may generate tracking information indicating the current position and orientation of the head region of the user 100, in the same or similar manner as described above for block 302.

In one embodiment, the sound generating device 52 may be at a different position and orientation for each HRTF determination. In such embodiment, in block 304, the tracking information may indicate a current known position and orientation of the user's head region relative to a current known position and orientation of the sound generating device 52.

Further in block 304, the relative position generation unit 14 may determine the position and orientation of the head region of the user relative to the position and orientation of the sound generating device 52, based on the tracking information obtained for the respective current positions and orientations of the user's head region and the device 52. For each measurement of the user's head region position and orientation, the position and orientation of the user's head region relative to the position and orientation of the sound generating device 52 may be obtained, based on the tracking information. In one embodiment, when the device 52 is at the same known position and orientation as when the relative position and orientation of the user's head region is determined for the initial user head region position and orientation, the relative position and orientation of the user's head region to the device 52 may be obtained by comparing the current orientation and position of the head region of the user 100, as indicated by the tracking information, with the known position and orientation of the sound generating device 52, using the data 42 indicating the known position and orientation of the sound generating device 52 and tracking information indicating distance 121 of the user 100 relative the device 52 and also orientation of the user's head region relative to the sound generating device 52 in terms of azimuth angle 120 and elevation angle 122.

In block 308, the movement data generation unit may generate movement data indicating a direction that the user 100 needs to move his head region to position the head region at a target position and orientation, at which a HRTF measurement may be made. For each HRTF measurement to be made, a desired relative position and orientation of the head region of the user 100 and the sound generating device 52 may be obtained, by referencing target data 44 indicating a pre-defined target azimuth angle, target elevation angle and target distance for the head region in relation to the current position and orientation of the sound generating device 52, where the target data is determined based on the known position and orientation of the device 52 as determined when the reference known relative position and orientation between the device 52 and the user's head region is determined with the user's head region at the initial user head region position and orientation. Pre-defined sets of target azimuth angle and target elevation angles with the same target distance may be defined as the target data and calculated by the generation unit 16 based on the known position and orientation of the sound generating device and the reference known relative position and orientation information indicated in the data 42. In one embodiment, target positions and orientations for the user's head region indicated by the target information may be respectively in relation to locations on an outer surface of a sphere having its center at the current position of the head region of the user, where the locations are at a same radius equal to the target distance. The target positions and orientations for the user's head region used to determine HRTFs, according to the present disclosure, may be determined to correspond to locations generally selected to be within some minimum angle apart from each other along the outer surface of the sphere, typically less than 10 degrees, and in some embodiments less than 5 degrees.

In block 310, the movement data generation unit 16 may generate display data, according to the movement data, indicating a direction in which the user needs to move his head region to position and orient the head region at a target position and orientation. The unit 16 may supply the display data to the display unit 22, such that the user is visually guided to modify his head region position and/or orientation towards the target azimuth angle, target elevation angle and target distance corresponding to the current target position and orientation. In one embodiment, referring to FIG. 7, the display data may include information that provides for display on a screen display 126 of a current position indicator 132, which provides the user 100 with an indication of the current position and orientation of his head region; a target indicator 134 that provides the user 100 with an indication of the desired position and orientation of his head region; and guidance indicators 136, such as arrows pointing in predetermined directions, that provide the user 10 with information to properly position and orient his head region so that the head region is positioned and oriented at the target position and orientation. For example, when the apparatus 10 includes a head mounted visual display 126 as part of the display unit 24, such indicators 132, 134 and 136 may displayed on a display indicating stimulus for orienting and positioning the head region relative to the position and orientation described by target azimuth angle, target elevation angle and target distance, where the current position indicator 132, in conjunction with guidance indicators 134, provide further stimulus with regard to necessary changes in orientation and position of the head region of the user to align the current position indicator 132 with the target indicator 134.

In another embodiment, the movement data generation unit 16 may generate audio guidance data, according to the movement data, indicating a direction in which the user needs to move his head region to position and orient the head region at a target position and orientation. The unit 16 may supply the audio guidance data to the audio signal generation unit 24 or the sound generating device 52, such that the user is audibly guided to modify his head region position and/or orientation to obtain the target azimuth angle, target elevation angle and target distance. For example, the audio guidance data may cause the unit 24 to generate audible sounds such as "Move Left", "Look Up", "Turn Right", "Tilt Left" and the like.

In block 310, the operations of the blocks 304, 306 and 308 may be repeated until the position and orientation of the head region of the user 100 relative to the sound generating device 52 match a target azimuth angle, target elevation angle and target distance to within some margin of error. In one embodiment, the margin of error may be set to below 10%. As such, in block 310, the movement data may be generated, and visible and/or audible guidance may be provided to the user, as long as the current head region orientation and position of the user 100 does not match the target head region orientation and position of the user 100, as determined by the movement data generation unit 16. When a match is determined, processing in block 312 is performed.

In block 312, the HRTF determination unit 18 may determine a HRTF for the current target position and orientation. At block 312, the head region of the user 100 has been determined to be properly positioned and oriented with respect to the sound generating device 52 for the current target position and orientation. The HRTF unit 18 may generate control signals which are transmitted to the sound generating device 52 to cause the sound generating device 52 to generate audible signals, or test signals, that the microphones of the detection unit 20 may detect. During the measurement of the HRTF by detection of the audio signals generated by the sound generating device 52, the user needs to remain still at the target position and orientation. As such, during the measurement of the HRTF, the HRTF unit may cause the display unit 22 to display on the display device, or the audio unit 24 to generate audible sound, instructing the user to remain still and silent for the duration of the measurement of the HRTF. The test signals may be in the form of impulse responses, frequency sweeps, or maximum length sequences, and it is to be understood many alternate and suitable test signal methodologies may be used. Based on processing of the detected audio data and test signal information corresponding to the test signals as transmitted from the device 52, a HRTF may be determined for the user having the head region positioned and orientated at the target position and orientation relative to the sound source.

The blocks 304-312 may be repeated for other target positions and orientations determined from the data 42 and saved in memory as the target data 44, such that HRTFs may be determined at all desired positions and orientations for the user's head region. The HRTFs may be determined for a same position and orientation of the sound generating device as when the initial user head region position and orientation relative to the position and orientation of the sound generating device is determined, or for a respective plurality of different positions and orientations of the sound generating device, where for any determination of HRTF both the user and the sound generating device do not move from the respective positions and orientations at which the tracking data indicating the relative position and orientation of the head region to the sound generating device is obtained.

Advantageously, the present disclosure may provide for measurement of multiple HRTFs quickly and accurately by guiding positioning and orienting of the head region of a test subject through utilization of a position tracking device, and a visual and/or an auditory output device. Further, the present invention may be implemented as a portable system that is inexpensive, allows for rapid measurement of individualized HRTFs outside of a laboratory or similar academic environment.

Figure 8:
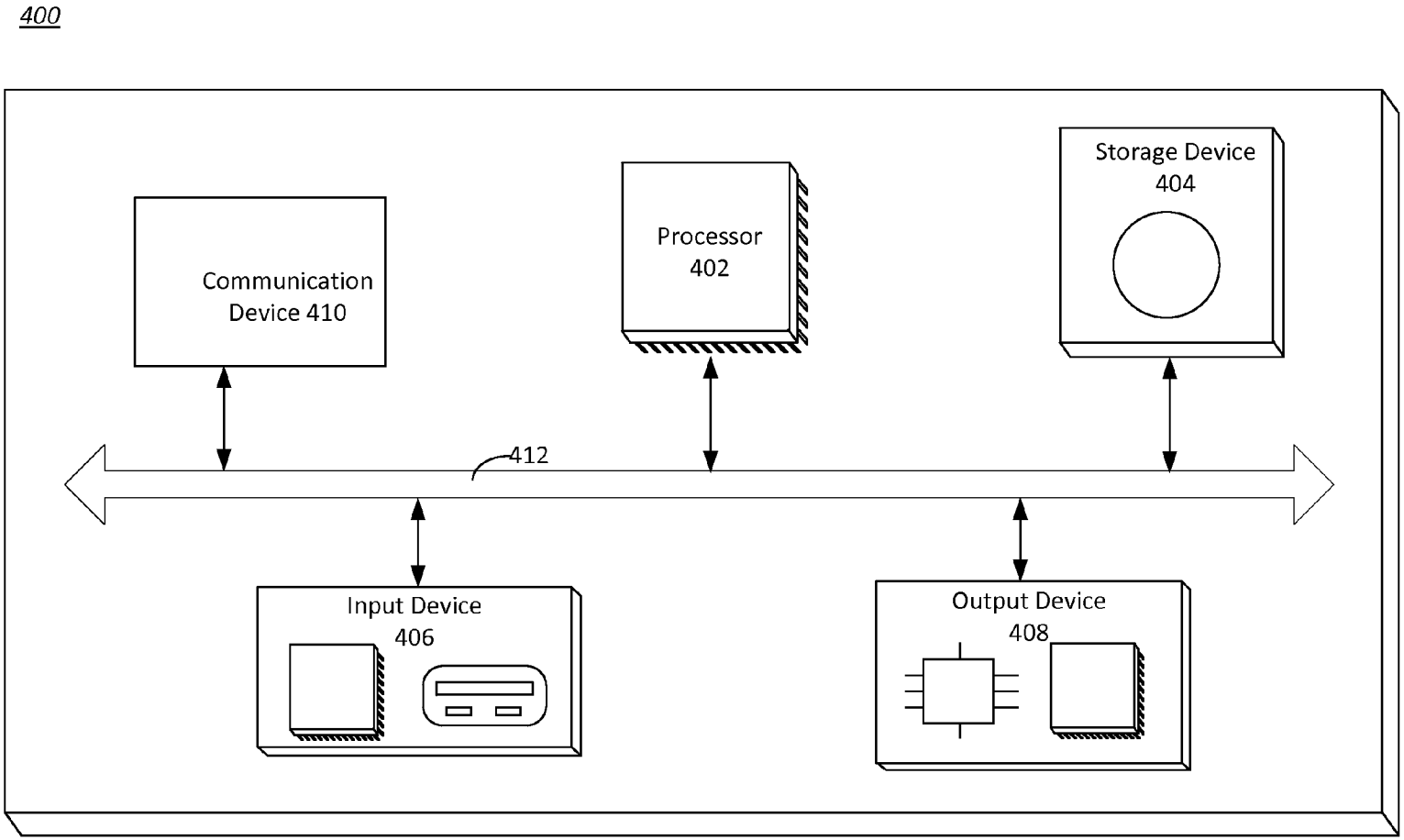
FIG. 8 is a block diagram illustrating a hardware configuration of an information processing device, according to present disclosure.

FIG. 8 is a schematic diagram of an exemplary hardware device 400 implementation of the apparatus 10, according to the present disclosure, that may perform the operations of the process 300. The device 400 may include one or more of the following components: one or more processors 402, a storage device 404, an input device 406, an output device 408 and a communication device 410. Components of the device 400 may be communicatively coupled together in either a wired or wireless fashion, and communicatively coupled to the imaging device 50 and sound generating device 52 via wired or wireless communication. In some cases, the methodologies of the processing components may be achieved in a single processor or multiple processors. In one example, the components of the device 408 may be coupled together by a system bus 412.

The processor 402 may be a CPU that functions as an arithmetic processing unit and a control unit, and controls the entire operation within the device 400 or a part thereof in accordance with various programs recorded on ROM and/or RAM of storage device 404, or a removable recording medium (not shown). The storage device 404 may store programs and data used by the processor 402. The processor and storage device are connected by the bus 412.

The storage device 404 may be a device for storing data, constructed as an example of a storage unit of the device 400. The storage device 404 may include, for example, a magnetic storage device such as HDD (Hard Disk Drive), a semiconductor storage device, an optical storage device, or a magneto-optical storage device. The storage device 404 may include, for example, programs or various data executed by the processor 402 or data acquired from external to the device 400.

The input device 406 is a device used by a user such as, for example, a mouse, a keyboard, a touch panel, a button, a switch, or a lever. The input device 406 may be, for example, a remote control device that uses infrared rays or other radio waves. In one embodiment, the input device may be external communication and control device external to the device 400, such as a smartphone corresponding to the operation of the information processing device 400. The input device 406 may include an input control circuit that generates an input signal based on information input by a user and outputs the input signal to the processor 402. The user may, by operating the input device 406, input various data to the information processing device 400 or instruct the information processing device 400 to perform a processing operation. In addition, the input device 406 may include an audio signal detection device, such as microphones.

The output device 408 may include a device that can visually or audibly inform a user of information, such as the movement data. The output device 408 may include, for example, a display device such as an LCD (liquid crystal display), a PDP (Plasma Display Panel), an organic EL (Electro-Luminescence) display; and an audio signal generation device, such as a speaker or headphones. The output device 408 may output a result obtained through the processing of the information processing device 400 as text or video such as an image or as sound.

The communication device 410 may be, for example, a communication interface including a communication device or the like for connection to a communications network. The communication device 410 may be, for example, a wired or wireless LAN (Local Area Network), or a communication card for Bluetooth (registered trademark) or WUSB (Wireless USB). The communication device 410 may transmit or receive signals or the like via the Internet or to/from other communication devices. The communication device may include a connection port for directly connecting a device to the information processing device 400. The connection port may be, for example, a USB (Universal Serial Bus) port, an IEEE 1394 port, or an SCSI (Small Computer System Interface) port, an optical audio terminal, or an HDMI (High-Definition Multimedia Interface) port.

Although aspects of the disclosure herein have been described with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure as defined by the appended claims.

The invention claimed is:

1. A method for measuring a Head-Related Transfer Function (HRTF), the method comprising:

controlling, by a processing device, determining position and orientation of an object relative to an audio signal generating device having a first known position and orientation, based on tracking information indicating position and orientation of the object;

generating movement data indicating direction of movement to position the object at a target position and orientation in relation to a predetermined position and orientation of the audio signal generating device, according to the relative position and orientation of the object, in which the target position and orientation of the object is a position and orientation for the object at which an audio signal measurement is to be performed for determining a first HRTF; and responsive to a determination that the object is at the target position and orientation following the generating of the movement data, supplying an audio signal from the audio signal generating device which is at the first known position and orientation while the object is at the target position and orientation; and determining the first HRTF based on detection at the object of the audio signal.

2. The method of claim 1 further comprising:

controlling, by the processing device, rendering of the movement data at least one of audibly or visually.

3. The method of claim 2, wherein the movement data is rendered by visually indicating on a display first indicia of the target position and orientation, second indicia of a current position and orientation of the object in relation to the target position and orientation and third indicia of direction guidance.

4. The method of claim 1, wherein the movement data is rendered audibly by the audio signal generating device or another audio signal generating device of an apparatus including the processing device.

5. The method of claim 1, wherein the tracking information is from a position tracking device configured for coupling to the object.

6. The method of claim 1, wherein the tracking information is from an imaging device.

7. The method of claim 5, wherein the tracking information is based at least one of an optical, acoustic or electromagnetic signal received at an apparatus configured for coupling to the object and including the tracking device and the processing device.

8. The method of claim 1, wherein the target position and orientation are indicated by information of predetermined azimuth angle, predetermined elevation angle and predetermined distance of a target in relation to the predetermined position and orientation of the audio signal generating device.

9. The method of claim 1, wherein, for each of a plurality of target positions and orientations corresponding respectively to second known positions and orientations of the audio signal generating device arranged spaced at least about a predetermined minimum angle around the object and at a radius of a predetermined distance from a portion of the object, in which each of the target positions and orientations is according to the second known positions and orientations in relation to the predetermined position and orientation of the audio signal generating device, the movement data is generated and a corresponding second HRTF is determined, wherein the object is a person and the portion of the object is a head region of the person.

10. An apparatus for measuring a Head-Related Transfer Function (HRTF), the apparatus comprising:

a processing device configured to control:

determining position and orientation of an object relative to an audio signal generating device having a first known position and orientation, based on tracking information indicating position and orientation of the object;

generating movement data indicating direction of movement to position the object at a target position and orientation in relation to a predetermined position and orientation of the audio signal generating device, according to the relative position and orientation of the object, in which the target position and orientation of the object is a position and orientation for the object at which an audio signal measurement is to be performed for determining a first HRTF; and responsive to a determination that the object is at the target position and orientation following the generating of the movement data, supplying an audio signal from the audio signal generating device which is at the first known position and orientation while the object is at the target position and orientation; and determining the first HRTF based on detection at the object of the audio signal.

11. The apparatus of claim 10, wherein the processing device is configured to control rendering of the movement data at least one of audibly or visually.

12. The apparatus of claim 11, wherein the movement data is rendered by visually indicating on a display first indicia of the target position and orientation, second indicia of a current position and orientation of the object in relation to the target position and orientation and third indicia of direction guidance.

13. The apparatus of claim 12, wherein the apparatus is configured for coupling to the object and includes the display.

14. The apparatus of claim 12, wherein the movement data is rendered audibly by the audio signal generating device or another audio signal generating device of the apparatus.

15. The apparatus of claim 10, wherein the tracking information is from a tracking device of the apparatus, and wherein the apparatus is configured for coupling to the object.

16. The apparatus of claim 10, wherein the tracking information is from an imaging device.

17. The apparatus of claim 10, wherein the tracking information is based on at least one of an optical, acoustic or electromagnetic signal received at the apparatus.

18. The apparatus of claim 10, wherein the target position and orientation are indicated by information of predetermined azimuth angle, predetermined elevation angle and predetermined distance of a target in relation to the predetermined position and orientation of the audio signal generating device.

19. The apparatus of claim 10, wherein, for each of a plurality of target positions and orientations corresponding respectively to second known positions and orientations of the audio signal generating device arranged spaced at least about a predetermined minimum angle around the object and at a radius of a predetermined distance from a portion of the object, in which each of the target positions and orientations is according to the second known positions and orientations in relation to the predetermined position and orientation of the audio signal generating device, the movement data is generated and a corresponding second HRTF is determined, wherein the object is a person and the portion of the object is a head region of the person.

20. A non-transitory storage medium on which is recorded a program executable by a computer, the program comprising:

determining position and orientation of an object relative to an audio signal generating device having a first known position and orientation, based on tracking information indicating position and orientation of the object;

generating movement data indicating direction of movement to position the object at a target position and orientation in relation to a predetermined position and orientation of the audio signal generating device, according to the relative position and orientation of the object, in which the target position and orientation of the object is a position and orientation for the object at which an audio signal measurement is to be performed for determining a first HRTF; and responsive to a determination that the object is at the target position and orientation following the generating of the movement data, supplying an audio signal from the audio signal generating device which is at the first known position and orientation while the object is at the target position and orientation; and determining the first HRTF based on detection at the object of the audio signal.

* * * * *